US006367083B1

(12) United States Patent
November

(10) Patent No.: US 6,367,083 B1
(45) Date of Patent: Apr. 9, 2002

(54) MULTIPLE USE BLANKET CONVERTIBLE INTO SLEEPING BAG AND CUSHION CONFIGURATIONS

(75) Inventor: Carl J. November, 36 Griffing Rd., Westhampton Beach, NY (US) 11978

(73) Assignee: Carl J. November, Westhampton Beach, NY (US)

( * ) Notice: Subject to any disclaimer, the term of this patent is extended or adjusted under 35 U.S.C. 154(b) by 0 days.

(21) Appl. No.: 09/442,955

(22) Filed: Nov. 18, 1999

(51) Int. Cl.[7] ..... A47G 9/08
(52) U.S. Cl. ..... 2/69.5; 5/413 R; 5/485
(58) Field of Search ..... 2/69.5; 5/413 R, 5/482, 485, 502, 417, 419, 420

(56) References Cited

U.S. PATENT DOCUMENTS

| | | | | |
|---|---|---|---|---|
| 2,109,951 A | | 3/1938 | Truesdell et al. | 2/88 |
| 2,183,418 A | | 12/1939 | Williams | 5/334 |
| 2,611,899 A | | 9/1952 | Nelson | 2/69.5 |
| 3,284,818 A | | 11/1966 | Lutz | 5/343 |
| 3,381,306 A | | 5/1968 | Innes | 2/69 |
| 3,477,552 A | | 11/1969 | Goldman | 190/2 |
| 3,584,323 A | | 6/1971 | Worley | 5/343 |
| 4,258,439 A | | 3/1981 | York | 2/69.5 |
| 4,752,971 A | | 6/1988 | Meserol | 2/88 |
| 5,005,235 A | * | 4/1991 | Huang | 5/413 |
| 5,172,440 A | * | 12/1992 | Ming | 5/485 |
| 5,414,881 A | | 5/1995 | Terrazas | 5/417 |
| 5,588,749 A | | 12/1996 | Ishikawa | 383/4 |
| 5,657,489 A | | 8/1997 | Ponstein | 2/69 |
| 5,987,667 A | * | 11/1999 | Haverly et al. | 5/485 |
| 6,105,168 A | * | 8/2000 | Hazen | 2/69.5 |

OTHER PUBLICATIONS

Gershman, "Self–Adhering Nylon Tapes", J.A.M.A., vol. 68, No. 7, p. 930, Oct. 1958.*

* cited by examiner

*Primary Examiner*—Peter Nerbun
(74) *Attorney, Agent, or Firm*—Brown Raysman Millstein Felder & Steiner LLP

(57) ABSTRACT

A multiple use blanket which can be converted into a sleeping bag or pouch configuration and into a compact cushion, pillow or storage configuration. In a fully unfolded configuration, the blanket may be used as a blanket, wrap or, when provided with a water-resistant outer layer, as a poncho-like wrap. The blanket has a closure system (e.g., a zipper, hook and loop system, snaps, buttons, a zip lock system, etc.) in a central region of the blanket into which the blanket can be folded or otherwise manipulated, and the closure system closed around the compacted blanket to provide the compact configuration of the blanket. The location of the closure system provides a neat, clean and convenient way to compact the blanket, and an attractive appearance, as well as functionality as a pillow or cushion. Another closure system is provided about the periphery of the blanket which allows the blanket to be folded and configured as a sleeping bag or stadium bag or pouch.

5 Claims, 8 Drawing Sheets

MULTIPLE USE BLANKET CONVERTIBLE INTO SLEEPING BAG AND CUSHION CONFIGURATIONS

BACKGROUND OF THE INVENTION

The invention disclosed herein relates to a multiple use blanket which may be converted into a sleeping bag configuration and into a cushion, pillow or storage configuration.

Multiple use blanket, sleeping bag or the like items provide certain conveniences in addition to the uses to which the particular item is put. A basic convenience is the capability of converting the item to a compact configuration for storage or transporting or use as a pillow, for example. Some single use blanket or like items also provide this convenience of converting to a compact configuration. The patents identified below provide examples.

U.S. Pat. No. 2,183,418 discloses a coverlet that can be configured into a pillow. U.S. Pat. No. 2,611,899 discloses a lap robe or blanket convertible into a sleeping bag configuration. U.S. Pat. No. 3,477,552, discloses a combination mat and tote bag. The mat is foldable into a tote bag having two pockets on the exterior of the bag for carrying things. Ribbons attached to the mat are tied to retain the bag in its folded configuration, and straps are provided for carrying the bag.

U.S. Pat. No. 3,381,306, discloses a multiple use blanket which the patent states can be used as a conventional blanket, car blanket, lap robe, beach blanket, serape, poncho, dressing tent, beach bag and sleeping bag. The blanket is provided with a pocket into which the blanket can be folded or rolled. This item can also be joined with a similar blanket to form a huddle bag for two persons. A zipper is provided for each side of the blanket and a zipper is provided to close the pocket. Another zipper provides the opening for use as a serape or poncho.

U.S. Pat. No. 5,414,881 discloses an item than can be used as a stadium blanket, waterproof covering (with a removable hood) and a cushion. U.S. Pat. No. 5,588,749, discloses a multiple use item that can be used as an ordinary bag, a pair of seats, a cushion, a lap robe, a sleeping bag and a hooded poncho. This item consists of three separate pieces, a blanket which can be converted into a sleeping bag configuration, a hood which is attachable to the blanket for use as a poncho, and a bag which can be used as a seat cushion and for carrying the blanket and the hood (as well as other things). See also U.S. Pat. Nos. 2,109,951, 3,284,818, 3,584,323, 4,258,439, 4,752,971 and 5,657,489.

Despite the existence of prior multiple use and/or compactable blankets, mats, sleeping bags and like items, there is a need for an item which functions as a blanket, a sleeping bag, stadium bag or pouch or like item, and a cushion or pillow that not only provides these uses but does so in a very convenient, neat and attractive manner.

OBJECTS AND SUMMARY OF THE INVENTION

It is an object of the invention disclosed herein to provide a multiple use blanket or like item that is more convenient to use.

It is another object of the invention to provide a blanket or like item that can be more conveniently and more neatly be folded or otherwise reconfigured into a compact configuration usable as a cushion or pillow, or which can be conveniently stored or transported.

The above and other objects are achieved in accordance with the invention by a blanket having a closure system (e.g., a zipper, hook and loop system, snaps, buttons, a zip lock system, etc.) extending to define a generally central region of the blanket into which the blanket can be folded or otherwise manipulated, and the closure system closed around the central region to provide a compact configuration of the blanket usable, for example, as a cushion or pillow, or in which configuration the blanket is suitable for storage and transporting.

In accordance with the invention, this closure system and its location provide not only the functionality described herein to compact the blanket, but also provide a neat and attractive appearance for a relatively tightly folded or compacted blanket.

Another closure system is provided about the periphery of the blanket which allows the blanket to be folded and configured as a sleeping bag or stadium bag or pouch.

In the preferred embodiment, the blanket has both of the closure systems described above, and can be used as a blanket, wrap or poncho-like wrap in the fully unfolded configuration, as a sleeping bag or pouch, etc. in a once-folded configuration and as a pillow or cushion in a compact configuration. The closure system for retaining the blanket in its compact configuration is located on only one side of the blanket so that it is positioned on the outside of the once-folded configuration and does not interfere with use of the blanket in that configuration. Similarly, the closure system for retaining the blanket in its compact configuration extends about the periphery of the compactly configured blanket so as not to interfere with its use as a pillow or cushion.

In a specific embodiment, the closure system which retains the blanket in its compact configuration has mutually attachable first and second closure parts which together extend in a partial or full loop in a central region of the fully unfolded blanket. To obtain the compact configuration of the blanket, the blanket is relatively tightly folded or manipulated into the central region within the periphery of the closure parts, i.e., within the loop. Thereafter, the blanket is folded or manipulated along an axis of symmetry of the loop or central region into the compact configuration with the first and second closure parts positioned adjacent each other for attachment together. The closure parts are engaged completely about the loop to provide a pillow or cushion, or partially to provide a sack-like configuration. The central region defined by the closure parts has an area which is less than half of the area of the unfolded blanket, and preferably one third or less of the area of the blanket, so that the area of the compact configuration is about one twelfth or less than the area of the unfolded blanket.

The closure system for use in configuring the blanket as a sleeping bag or stadium bag or pouch also has mutually attachable first and second closure parts. These parts extend in opposite directions along the periphery of the blanket in a fully unfolded configuration thereof. For example, in the preferred embodiment, they start in the middle of one side and extend for the complete adjacent side, so that when the closure system is closed, it provides a bag closed all along the periphery except for one side. The blanket is foldable once from the unfolded configuration about an axis of symmetry to position the first and second closure parts adjacent each other for attachment together for a sufficient distance to form a sack selectively openable and closable along one side of the once folded blanket.

The closure systems may be implemented by a zipper, hook and loop system, snaps, buttons, a zip lock system, etc.

In the preferred embodiment, the blanket is rectangular in its fully unfolded configuration and the loop is rectangular, so that the shape of the compact configuration of the blanket is also rectangular, and zippers are used for both closure systems. Also, in the preferred embodiment, the blanket comprises an inner layer and an outer layer. The outer layer is made of a weather resistant material while the inner layer is made of an insulating or comfortable fabric.

BRIEF DESCRIPTION OF THE DRAWINGS

The invention is illustrated in the figures of the accompanying drawings which are meant to be exemplary and not limiting, in which like references refer to like or corresponding parts, and in which.

DESCRIPTION OF THE PREFERRED EMBODIMENTS

Figure 1:
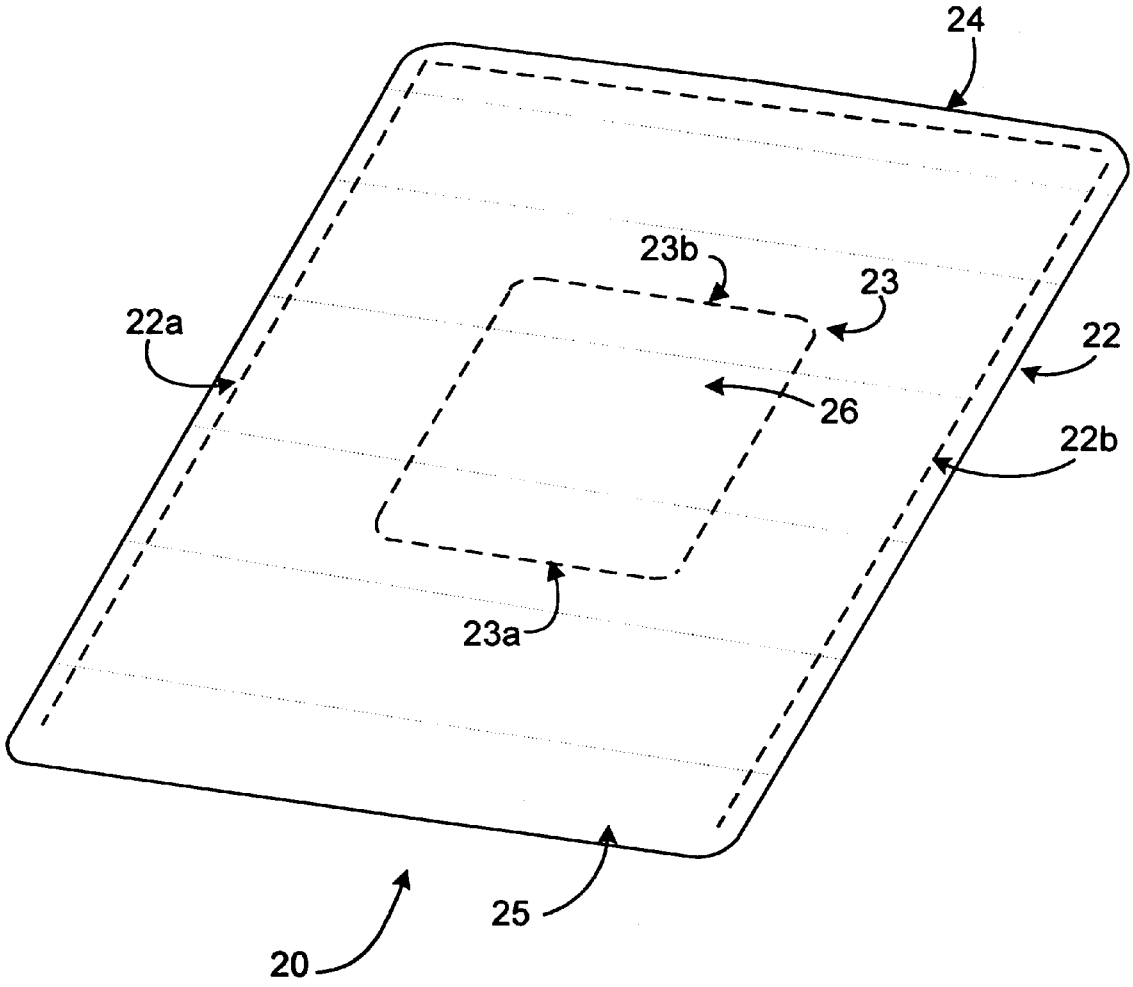
FIG. 1 is a top perspective view of a multiple use blanket according to the invention.

Referring first to FIG. 1, a blanket 20 incorporating the invention is shown in its fully unfolded configuration. The blanket 20 includes closure systems 22 and 23 which retain the blanket 20 respectively in folded configurations 30 (sleeping bag or once folded configuration) shown in FIG. 4 and 32 (compact configuration) shown in FIG. 8.

The closure system 22 has engaging closure parts 22*a*, 22*b* which extend oppositely along the periphery of the blanket starting in the middle of one side 24 to (but not including) the opposite side 25. The closure system 22 can be closed to a desired location when the blanket 20 is folded on itself into the once folded configuration 30 shown in FIG. 4.

Figure 8:
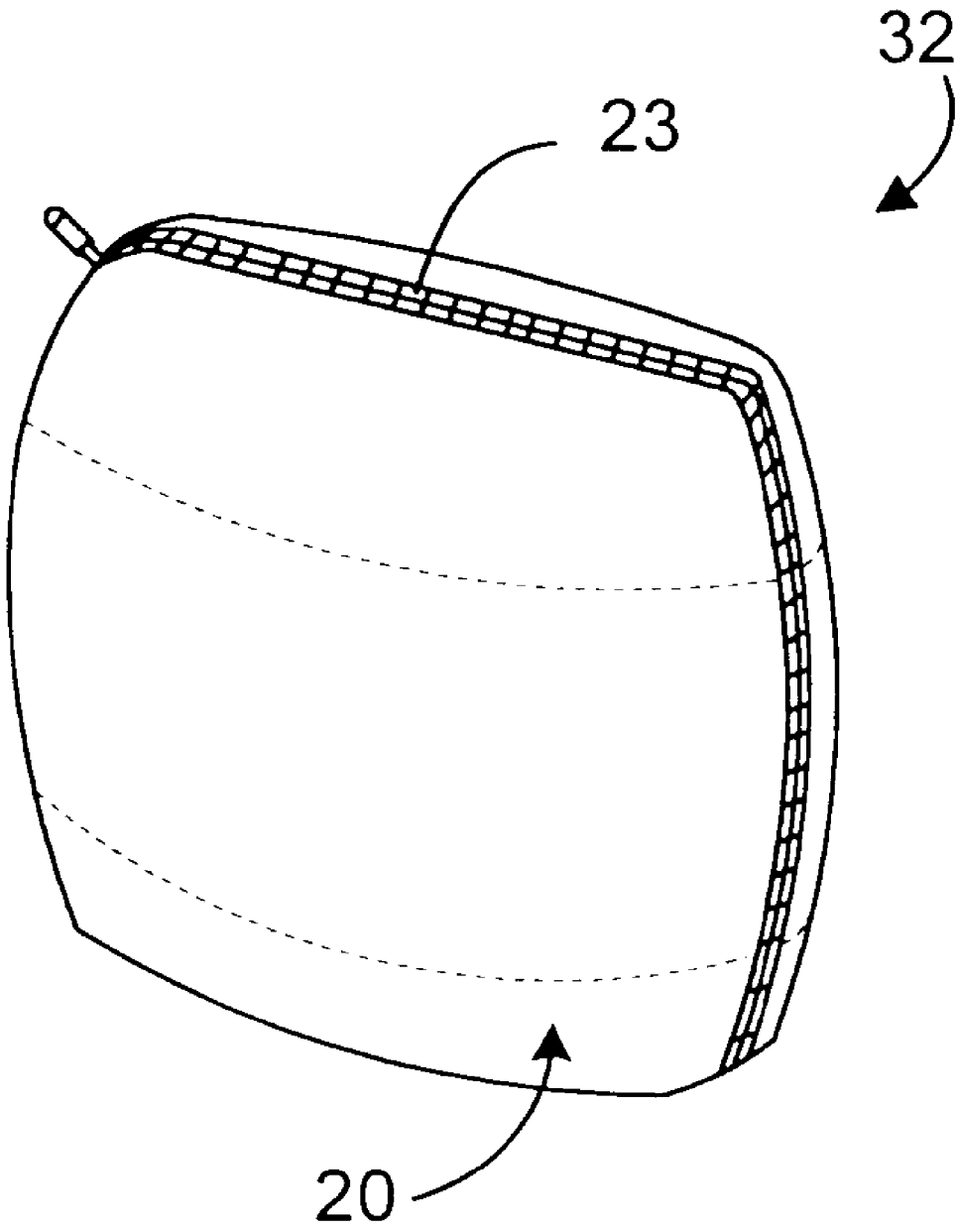
FIG. 8 is a perspective view of the blanket of FIG. 2 zipped closed from the configuration of FIG. 6 to form a cushion or pillow.

The closure system 23 has engaging parts 23*a*, 23*b* which together form a closed loop or area 26 in a central region of the blanket 20. When the blanket 20 is folded as shown in FIG. 8, the closure system 23 can be closed to retain the blanket in the compact configuration 32 for use as in a pillow or cushion or, if not fully closed, as a sack.

Depending upon the construction of the blanket 20 and the closure system 22, the blanket may be used under varying climatic conditions and for various purposes. However, the blanket 20 has particular application for use at outdoor sporting and other events which spectators view from seats, such as football games. For such applications, the blanket 20 in its folded configuration 30 may be used as a kind of pouch or sack that can be closed to a desired height around a person, and in its fully unfolded configuration as a wrap, or when provided with a water-resistant outer layer as a poncho-like wrap.

In the compact configuration 32 (FIG. 8), the blanket 20 is folded compactly for use a cushion or pillow, and for storage.

The blanket 20 thus has three use configurations as follows: in its fully unfolded configuration (FIGS. 1 and 2) as a conventional blanket, wrap, poncho, etc., in the once-folded configuration 30 (FIG. 4) as a sleeping bag or pouch, etc.; and in the compact configuration 32 (FIG. 8) as a cushion or pillow, or for storage, transporting, etc.

Referring to FIG. 1, the first closure system 22 may be a zipper system, a snap system, a button system, a hook and loop system (e.g., Velcro®), a continuous zip system (e.g., a "zip lock" system). All of these types of closures are known in the art. Therefore, they will not be described further. In the presently preferred embodiment, a zipper system is employed for the closure systems 22, 23 as illustrated.

Figure 3:
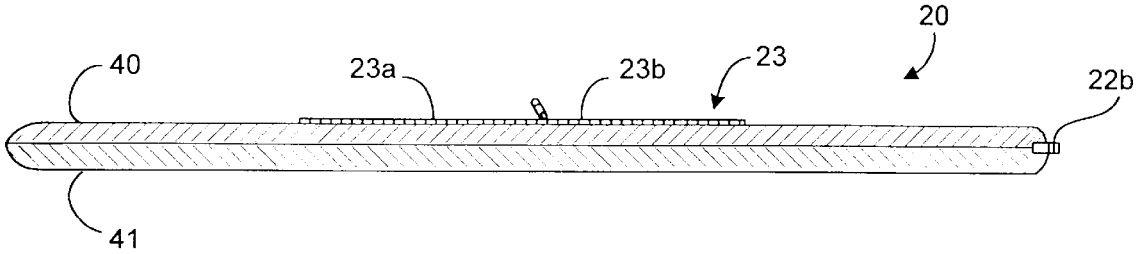
FIG. 3 is a cross sectional view of the blanket depicted in FIG. 2 taken along line 3—3 in FIG. 2.

As mentioned, the blanket 20 may be constructed in accordance with the use intended for the blanket. However, for general purpose outdoor use at sporting events, etc., for example as a stadium blanket, the blanket is constructed in two layers 40 and 41 (FIG. 3). The layer 40 is an outer layer and is made of a water repellent or otherwise weather resistant material. The second closure system 23 is incorporated in the outer layer so as not to interfere with use of the blanket in its first folded configuration.

The layer 41 is an inner layer and is made of an insulating material or a material which provides comfort to the user. Further insulating material (not shown) may be positioned between the inner and outer layers 40 and 41. Water repellent materials such as Nylon® or Gore-Tex®, and insulating materials such as natural and synthetic textiles (e.g., cotton, wool, polyester, fleece, etc.) are known in the art and will not be described further herein.

The layers 40 and 41 are conventionally attached, for example by stitching 43 and welts 44 (FIG. 3).

Figure 2:
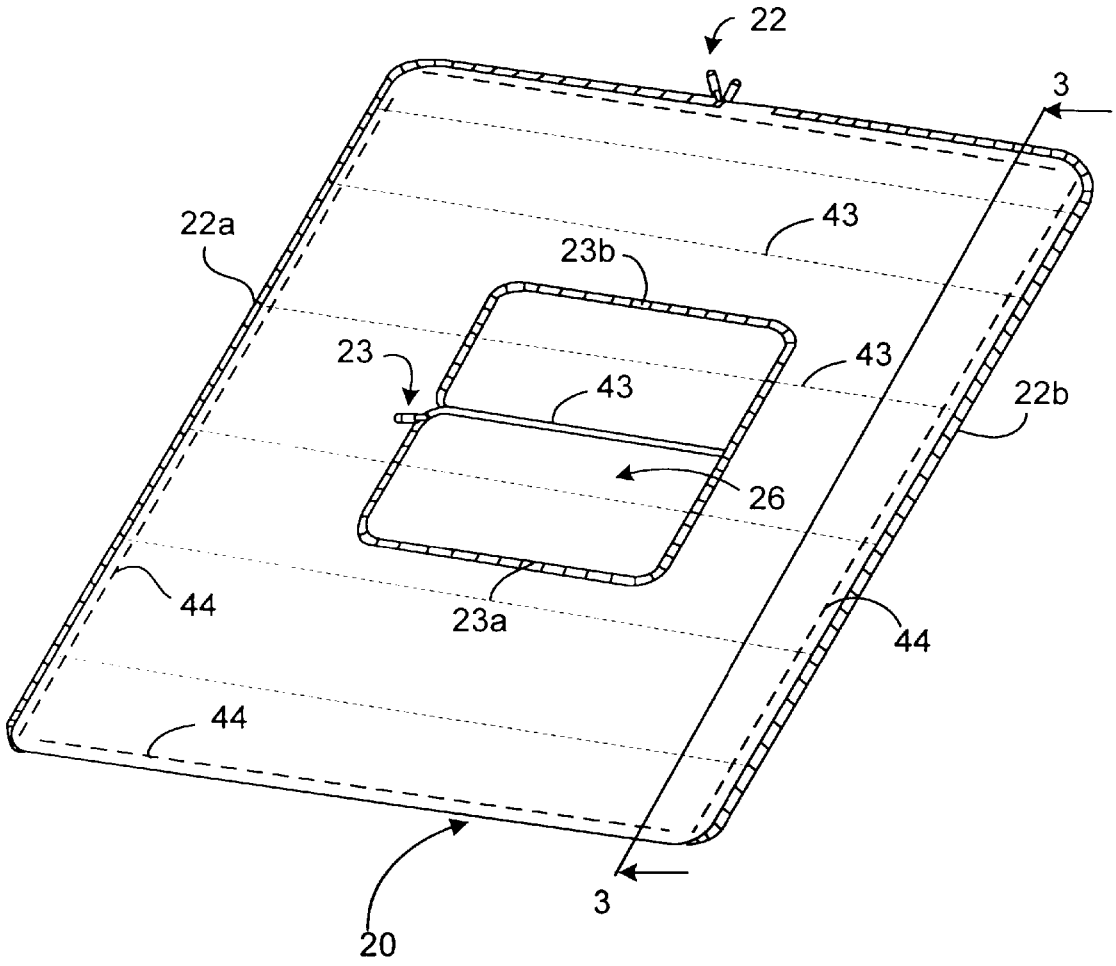
FIG. 2 is a top perspective view of a multiple use blanket according to a preferred embodiment of the invention which includes zipper closure systems.
Figure 4:
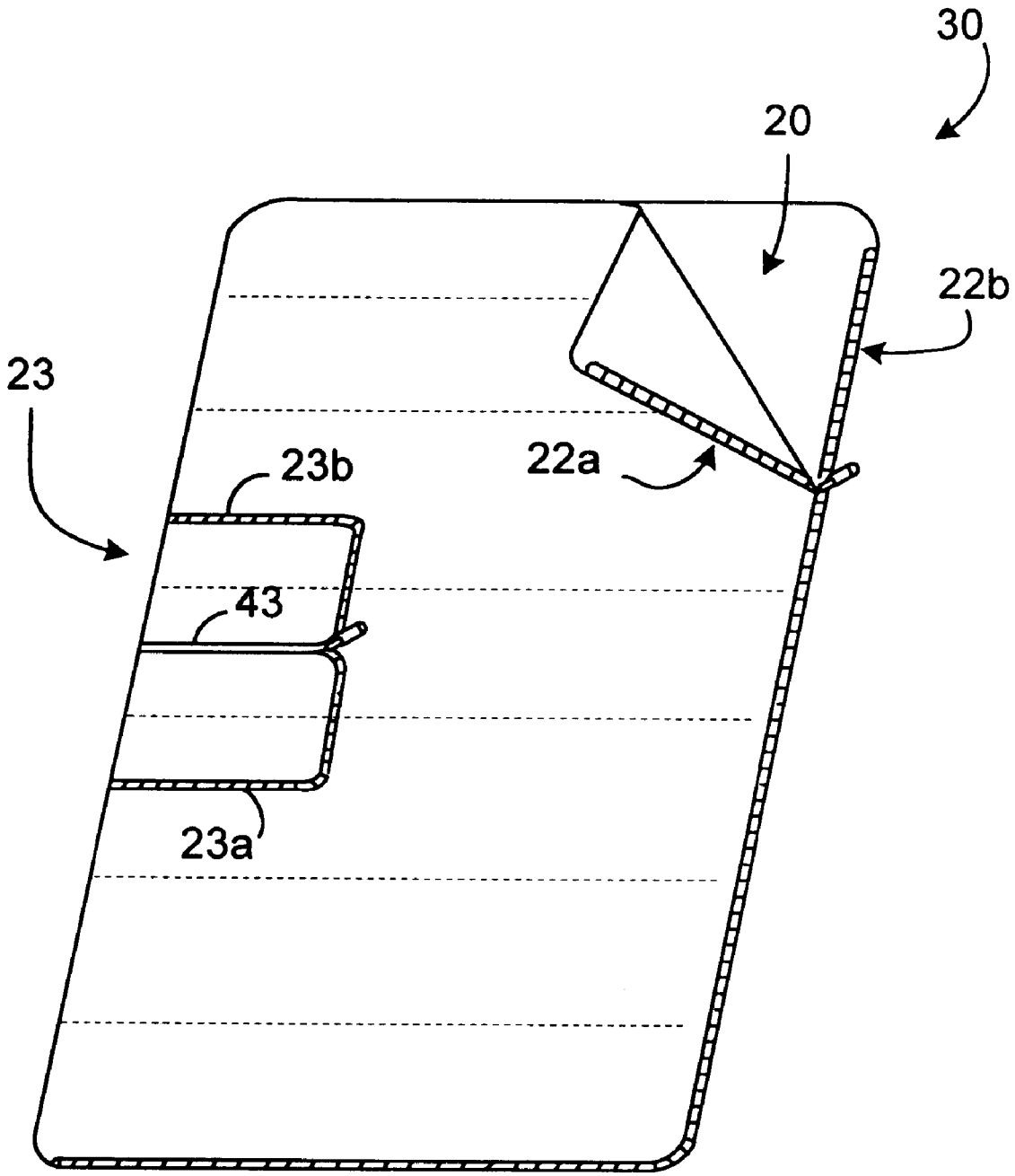
FIG. 4 is a perspective view of the blanket depicted in FIG. 2 folded in half from the unfolded configuration of FIG. 2 and zipped into a sleeping bag configuration.

Referring to FIG. 4, the unfolded blanket 20 (FIG. 2) is simply folded in half on itself to configure it for use as a sleeping bag. The zipper system 22 includes zipper parts 22*a* and 22*b* extending along opposed peripheries of the blanket 20 (FIG. 2). The zipper parts 22*a*, 22*b* are engaged and the zipper system 22 zipped a desired distance to close the blanket 20 into a sack, pouch or sleeping bag. The second closure system 23 is positioned on the outside of the folded configuration depicted in FIG. 4 so as not to interfere with its use as a sleeping bag.

Referring to FIGS. 5–8, the blanket 20 can be folded from its fully unfolded configuration (FIG. 2) into its compact configuration 32 (FIG. 8) as follows. The blanket is first folded on itself in thirds to provide the configuration depicted in FIG. 5. The second closure system 23 is on the bottom of this folded configuration and therefore is not seen in FIG. 5.

Figure 5:
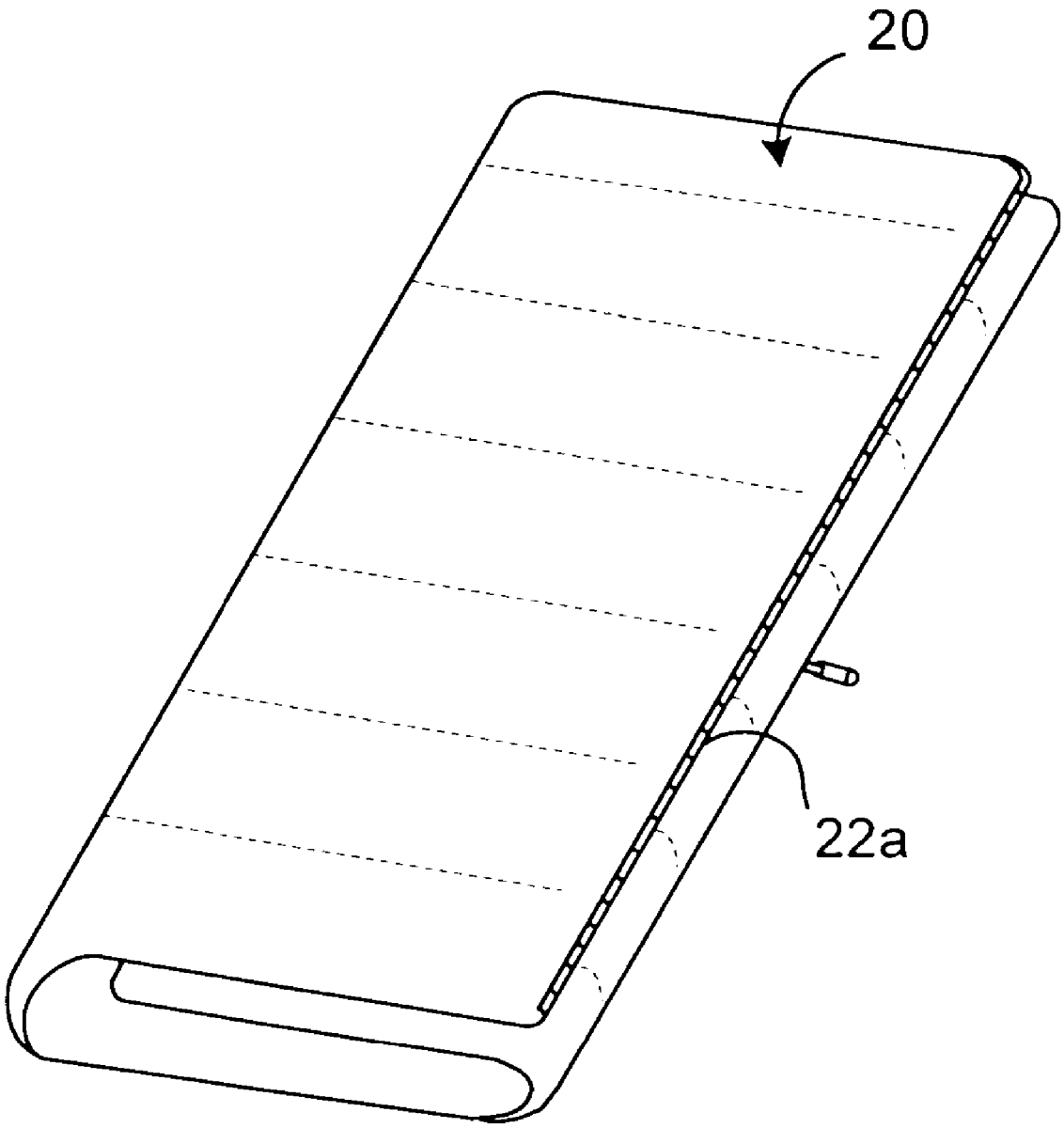
FIG. 5 is a perspective view of the blanket depicted in FIG. 2 folded into thirds from the unfolded configuration of FIG. 2.
Figure 6:
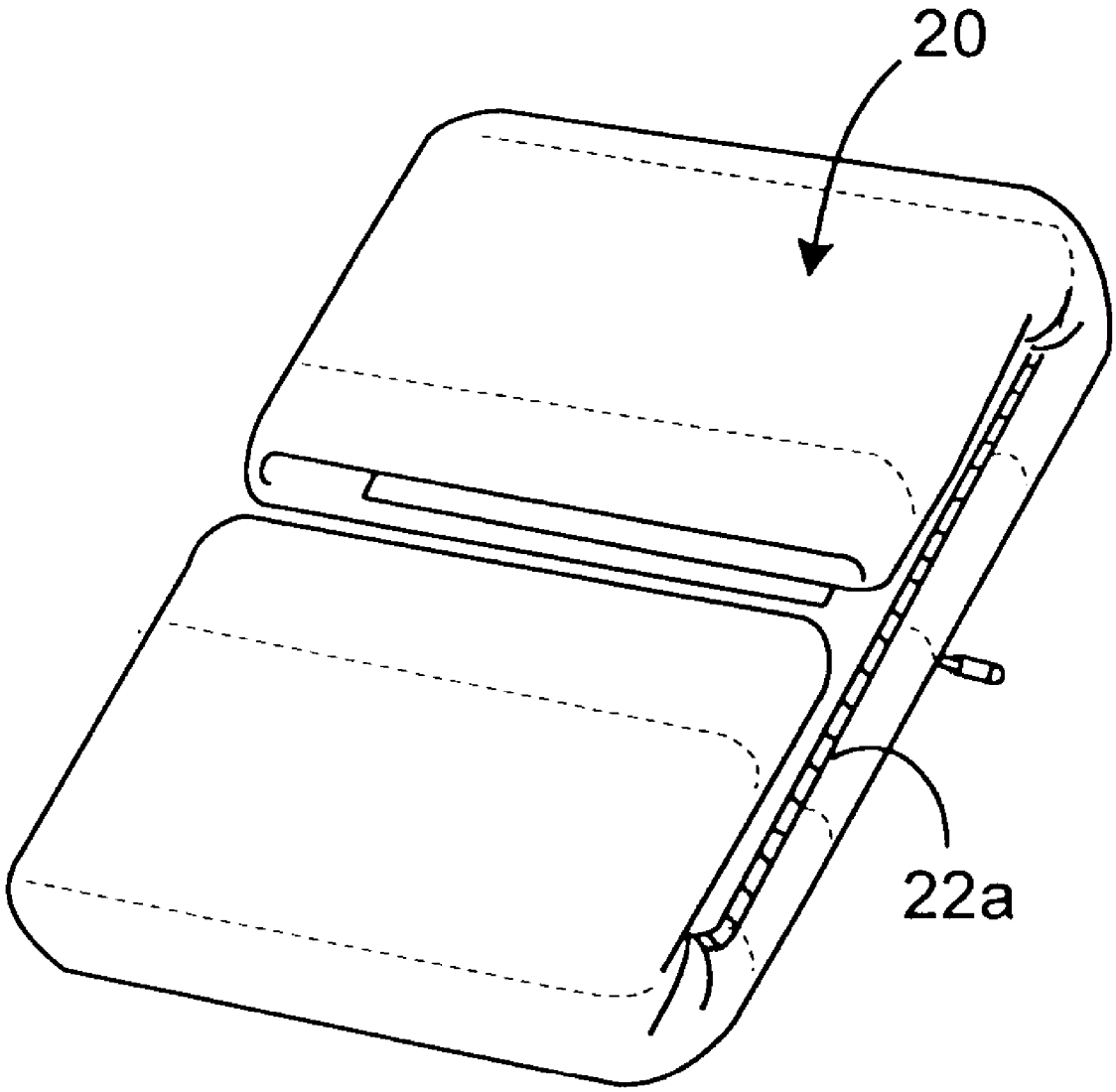
FIG. 6 is a perspective view of the blanket depicted in FIG. 2 folded into fourths from the configuration of FIG. 5.
Figure 7:
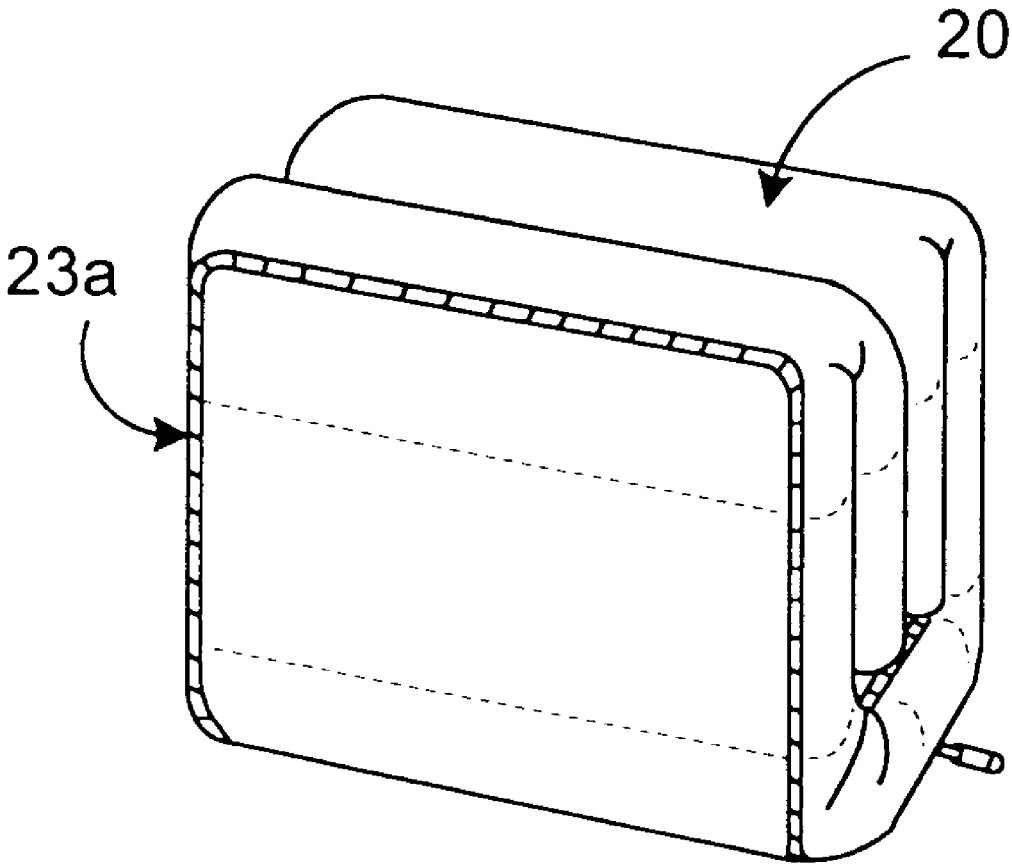
FIG. 7 is a perspective view of the blanket depicted in FIG. 2 folded half from the configuration of FIG. 6.

Then the folded blanket depicted in FIG. 5 is folded in quarters on itself as shown in FIG. 6. The second closure system 23 is also on the bottom of this folded configuration and therefore is not seen in FIG. 6. Next the folded blanket depicted in FIG. 6 is folded in half (along an axis of symmetry of the central region) as shown in FIG. 7. In this configuration, the closure system 23 extends about the periphery of the compact folded blanket and is then closed to provide the neat, clean and compact configuration depicted in FIG. 8. In this configuration, the compact blanket can be used as a cushion, pillow, etc., or can conveniently be stored or transported. Alternatively, the second closure system 23 may extend only partially about each loop 26, 27 (FIG. 1) or be closed only partially about the loops to provide a sack-like configuration.

The compact configuration 30 depicted in FIG. 8 results from folding the blanket 20 into twelfths. However, the blanket 20 may be folded into a more or less compact configuration For example, the blanket can initially be folded into fourths instead of into the thirds shown in FIG. 5. In such an embodiment, the closure system 23 would be one fourth instead of one-third the width of the unfolded blanket.

While the invention has been described and illustrated in connection with preferred embodiments, many variations and modifications, as will be apparent to those of skill in the art, may be made without departing from the spirit and scope of the invention. The invention as set forth in the appended clams is thus not limited to the precise details of construction set forth above as such variations and modifications are intended to be included within the spirit and scope of the invention as set forth in the defined claims.

What is claimed is:

1. The combination of a foldable blanket having a rectangular configuration in a fully unfolded configuration thereof and a plurality of closure systems for securing the blanket in a plurality of folded configurations, the plurality of closure systems including:

a first closure system having mutually attachable first and second closure parts starting at approximately the middle of a first side of the blanket extending in opposite directions along a periphery of the blanket in a fully unfolded configuration thereof to opposite sides of the blanket adjacent the first side, the blanket being foldable from the fully unfolded rectangular configuration about an axis of symmetry into a first folded rectangular configuration with the first and second closure parts positioned adjacent each other for attachment together for a sufficient distance to form a sack selectively openable and closable along at least part of one side of the folded blanket;

a second closure system having mutually attachable third and fourth closure parts which together extend in a substantially closed rectangular loop in a central region of the blanket in its fully unfolded configuration, the blanket being foldable into the central region and thereafter along an axis of symmetry of the loop into a second folded rectangular configuration with the third and fourth closure parts being adjacent to each other for attachment together, each of the third and fourth closure parts extending for half of the loop and being attachable in the second folded configuration of the blanket to form a fully closed rectangular sack;

the loop and the unfolded blanket each having an area with the area of the loop being less than half of the area of the unfolded blanket.

2. The combination of claim 1 wherein at least one of the first and second closure systems is a zipper system.

3. The combination of claim 1 wherein at least one of the first and second closure systems is a snap system.

4. The combination of claim 1 wherein at least one of the first and second closure systems is a hook and loop system.

5. The combination of claim 1 wherein at least one of the first and second closure systems is a continuous zip system.

* * * * *